US009789353B2

(12) United States Patent
Lalaoua

(10) Patent No.: US 9,789,353 B2
(45) Date of Patent: Oct. 17, 2017

(54) CORE ROLLER TWIST EXERCISE MACHINE

(71) Applicant: Nabile Lalaoua, Las Vegas, NV (US)

(72) Inventor: Nabile Lalaoua, Las Vegas, NV (US)

( * ) Notice: Subject to any disclaimer, the term of this patent is extended or adjusted under 35 U.S.C. 154(b) by 0 days.

(21) Appl. No.: 15/492,929

(22) Filed: Apr. 20, 2017

(65) Prior Publication Data

US 2017/0216659 A1 Aug. 3, 2017

Related U.S. Application Data

(63) Continuation-in-part of application No. PCT/IB2016/054191, filed on Jul. 13, 2016, which is a continuation-in-part of application No. 15/204,863, filed on Jul. 7, 2016, application No. 15/492,929, which is a continuation-in-part of application No. PCT/IB2016/005542, filed on Sep. 12, 2016, which is a continuation-in-part of application No. 15/258,047, filed on Sep. 7, 2016, application No. 15/492,929, which is a continuation-in-part of application No. PCT/IB2016/053903, filed on Jun. 29, 2016, which is a continuation-in-part of application No. 15/187,564, filed on Jun. 20, 2016, application No. 15/492,929, (Continued)

(51) Int. Cl.

| | |
|---|---|
| ***A63B 21/00*** | (2006.01) |
| ***A63B 21/04*** | (2006.01) |
| ***A63B 21/02*** | (2006.01) |
| ***A63B 23/02*** | (2006.01) |
| ***A63B 22/16*** | (2006.01) |

(52) U.S. Cl.

CPC ..... *A63B 21/4047* (2015.10); *A63B 21/023* (2013.01); *A63B 21/0407* (2013.01); *A63B 21/4035* (2015.10); *A63B 21/4039* (2015.10); *A63B 22/16* (2013.01); *A63B 23/0205* (2013.01); *A63B 2225/093* (2013.01)

(58) Field of Classification Search

USPC ..... 482/140

See application file for complete search history.

(56) References Cited

U.S. PATENT DOCUMENTS 4,838,547 A * 6/1989 Sterling ..... A63B 23/00 482/104

4,921,247 A * 5/1990 Sterling ..... A63B 17/00 482/130

(Continued)

*Primary Examiner* — Stephen R Crow

(57) ABSTRACT

An exercise device that effectively targets and engages the abdominal and core muscles. The device includes a backrest, a first graspable pole, a second graspable pole, a height-adjustable headrest, and a rocking base. The rocking base acts as the supporting structure and includes a first rocker, a second rocker, and a bridge. The first rocker and the second rocker are connected to the bridge on either side. The backrest receives a user's back and is adjacently and pivotably mounted to the bridge, opposite the first rocker and the second rocker. The first graspable pole and the second graspable pole are positioned opposite to each other across the backrest. The first graspable pole and the second graspable pole are each laterally and rotatably mounted to the backrest. The height-adjustable headrest is centrally mounted in between the first graspable pole and the second graspable pole to receive the user's head.

15 Claims, 5 Drawing Sheets

Related U.S. Application Data which is a continuation-in-part of application No. PCT/IB2016/054213, filed on Jul. 14, 2016, and a continuation-in-part of application No. 29/577,628, filed on Sep. 14, 2016, and a continuation-in-part of application No. 15/265,768, filed on Sep. 14, 2016, application No. 15/492,929, which is a continuation-in-part of application No. 15/265,791, filed on Sep. 14, 2016, and a continuation-in-part of application No. PCT/IB2016/055760, filed on Sep. 26, 2016, which is a continuation-in-part of application No. 15/265,791, filed on Sep. 14, 2016, application No. 15/492,929, which is a continuation-in-part of application No. PCT/IB2016/055761, filed on Sep. 26, 2016.

(60) Provisional application No. 62/231,629, filed on Jul. 13, 2015, provisional application No. 62/283,840, filed on Sep. 14, 2015, provisional application No. 62/391,111, filed on Apr. 20, 2016.

(56) References Cited

U.S. PATENT DOCUMENTS 5,080,353 A * 1/1992 Tench ..... A63B 21/154 482/130
5,090,694 A * 2/1992 Pauls ..... A63B 21/015 482/118
5,176,601 A * 1/1993 Reynolds ..... A63B 23/03525 482/121
5,324,243 A * 6/1994 Wilkinson ..... A63B 21/055 482/121
5,362,296 A * 11/1994 Wang ..... A63B 21/0552 482/121
5,387,171 A * 2/1995 Casey ..... A63B 21/0552 482/130
5,674,167 A * 10/1997 Piaget ..... A63B 21/0552 482/130
5,833,582 A * 11/1998 Chen ..... A63B 21/00072 482/115
5,899,836 A * 5/1999 Chen ..... A63B 21/0552 482/130
6,117,056 A * 9/2000 Cataldi, Jr. ..... A63B 21/0552 482/121
6,159,133 A * 12/2000 Shugg ..... A63B 21/023 482/121
6,220,995 B1 * 4/2001 Chen ..... A63B 21/02 297/175
6,537,185 B1 * 3/2003 Hur ..... A63B 23/1209 482/121
6,602,171 B1 * 8/2003 Tsen ..... A63B 21/023 482/140
6,752,745 B1 * 6/2004 Davis ..... A63B 21/00 482/129
6,872,170 B2 * 3/2005 Kuo ..... A63B 21/028 482/123
6,971,977 B1 * 12/2005 Chen ..... A63B 21/0552 297/258.1
6,981,932 B1 * 1/2006 Huang ..... A63B 21/00072 482/121
7,361,127 B2 * 4/2008 Tremayne ..... A63B 21/055 482/121
8,113,997 B2 * 2/2012 Fernandez ..... A63B 22/001 482/51
8,672,817 B2 3/2014 Bowser et al.
8,876,676 B2 11/2014 Lalaoua
9,278,253 B2 * 3/2016 Ho ..... A63B 21/00185
9,352,675 B2 * 5/2016 Walker ..... A47C 7/38
2004/0152572 A1 * 8/2004 Reitz ..... A63B 23/035 482/140
2012/0100973 A1 * 4/2012 Boland ..... A63B 22/14 482/142
2015/0105226 A1 * 4/2015 Lalaoua ..... A63B 23/0205 482/140
2015/0196798 A1 * 7/2015 Baschnagel ..... A63B 21/0004 482/140
2017/0014674 A1 * 1/2017 Lalaoua ..... A63B 22/0605
2017/0014677 A1 * 1/2017 Lalaoua ..... A63B 21/023
2017/0014678 A1 * 1/2017 Lalaoua ..... A63B 21/0552

* cited by examiner

CORE ROLLER TWIST EXERCISE MACHINE

The current application claims a priority to the U.S. Provisional Patent application Ser. No. 62/391,111 filed on Apr. 20, 2016.

FIELD OF THE INVENTION

The present invention relates generally to exercise devices. More specifically, the present invention is an abdominal exercise device that uses a rocking base and a pivoting backrest in order to engage and work out abdominal and core muscles groups.

BACKGROUND OF THE INVENTION

Exercising core muscles is a common way to stay physically fit. Specific exercises that target core muscles, including sit-ups, crunches, and planks can be useful for strengthening abdominal muscles but can also lead to injuries. Further, performing such exercises on hard surfaces can prove to be uncomfortable. Existing workout devices or machines typically move in one direction. This limits what exercises a user can perform. Further, repeatedly performing the same exercises can lead to decreased results when compared to varying exercise routines.

Accordingly, there is a present need for an exercise machine capable of comfortably and safely supporting a user through the performance of various abdominal exercises. The present invention is an abdominal exercise device that supports users while rocking or tilting on the present invention in order to strengthen core muscles. The present invention uses a hinged frame in conjunction with a rocking base in order to engage and workout core muscles from a multitude of different angles. Further, the present invention resists the movements of the user in order to enhance the strengthening of core muscles.

DETAIL DESCRIPTIONS OF THE INVENTION

All illustrations of the drawings are for the purpose of describing selected versions of the present invention and are not intended to limit the scope of the present invention.

The present invention is an exercise device that allows a user to efficiently and effectively strengthen his or her abdominal and core muscles. This is achieved through the use of a rocking base 13 in conjunction with a backrest 1 which guides the user to perform a crunch-like exercise at an elevated height and angled orientation. The crunch-like exercise forces the user to engage and contract the abdominal and core muscles simultaneously. Additionally, the present invention also forces the user to use his or her legs while performing the crunch-like exercise, thus engaging an additional muscle group. The present invention engages the upper and lower abdominal muscles, the lower back, the oblique muscles, the bun/buttons, quads, calves, and arm muscles. Additionally, the present invention can also be used as a cardio core workout to meltdown the middle section and to rapidly burn calories, making the present invention an all in one machine.

Figure 1:
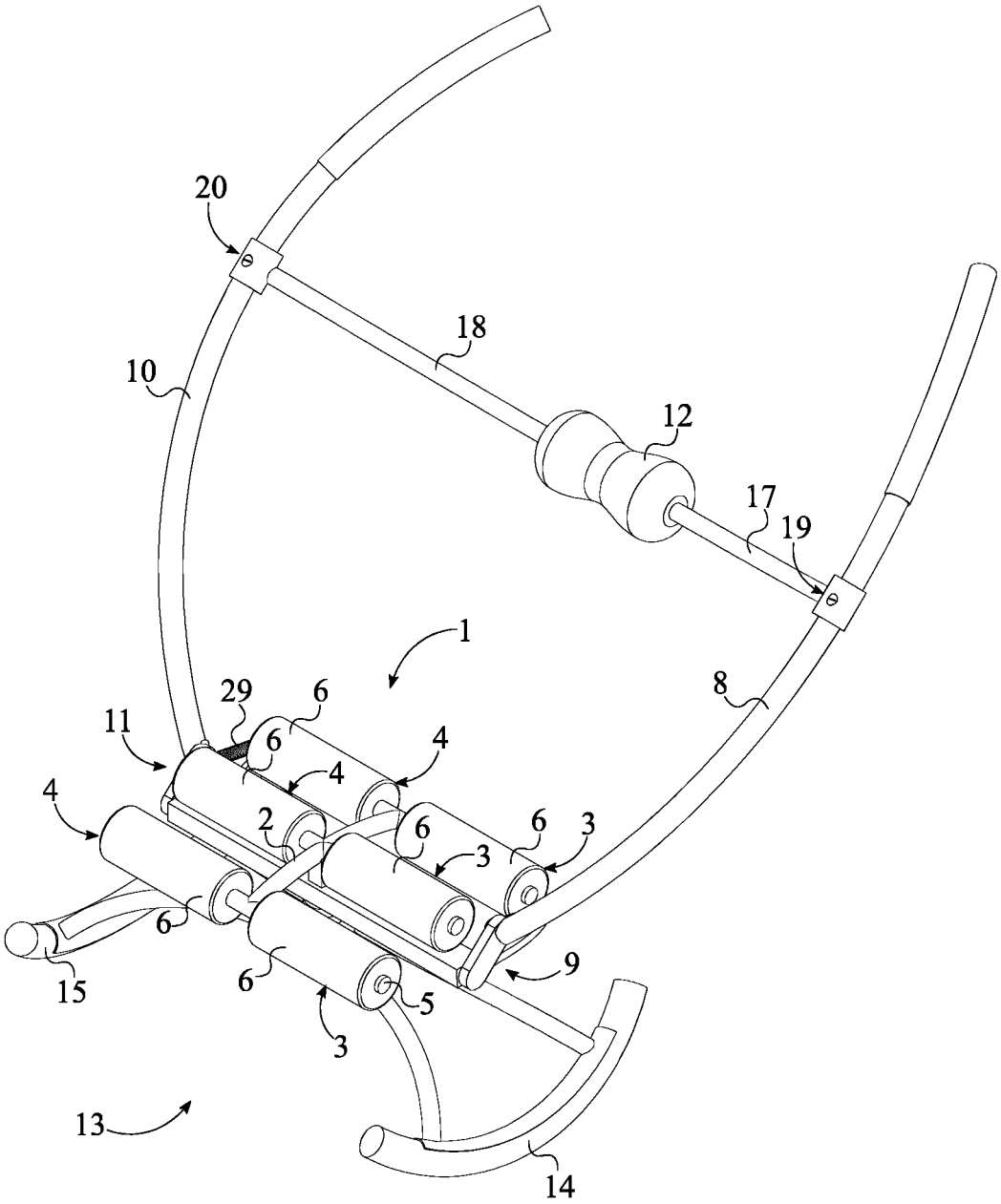
FIG. 1 is a perspective view of the present invention.
Figure 3:
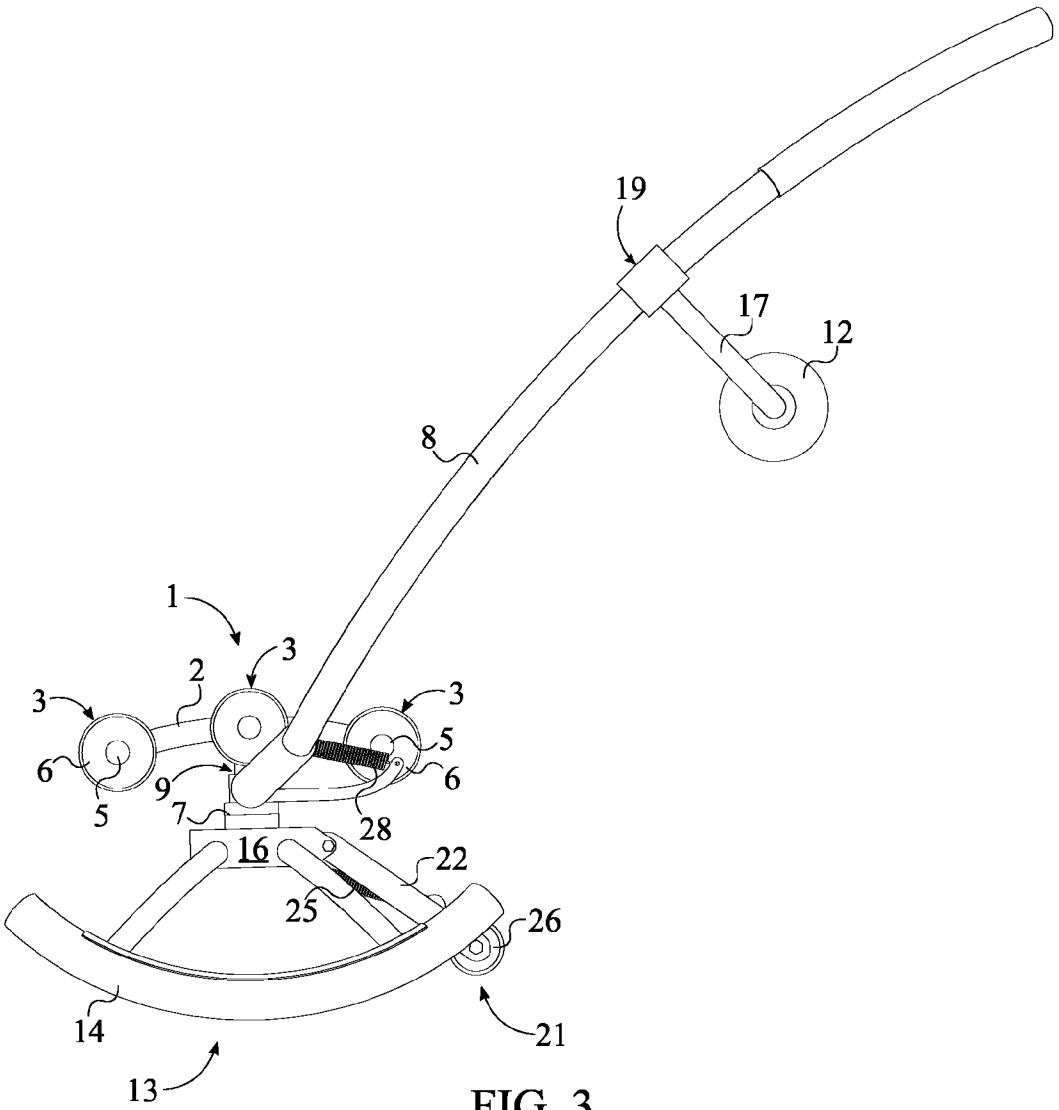
FIG. 3 is a left-side view of the present invention.
Figure 4:
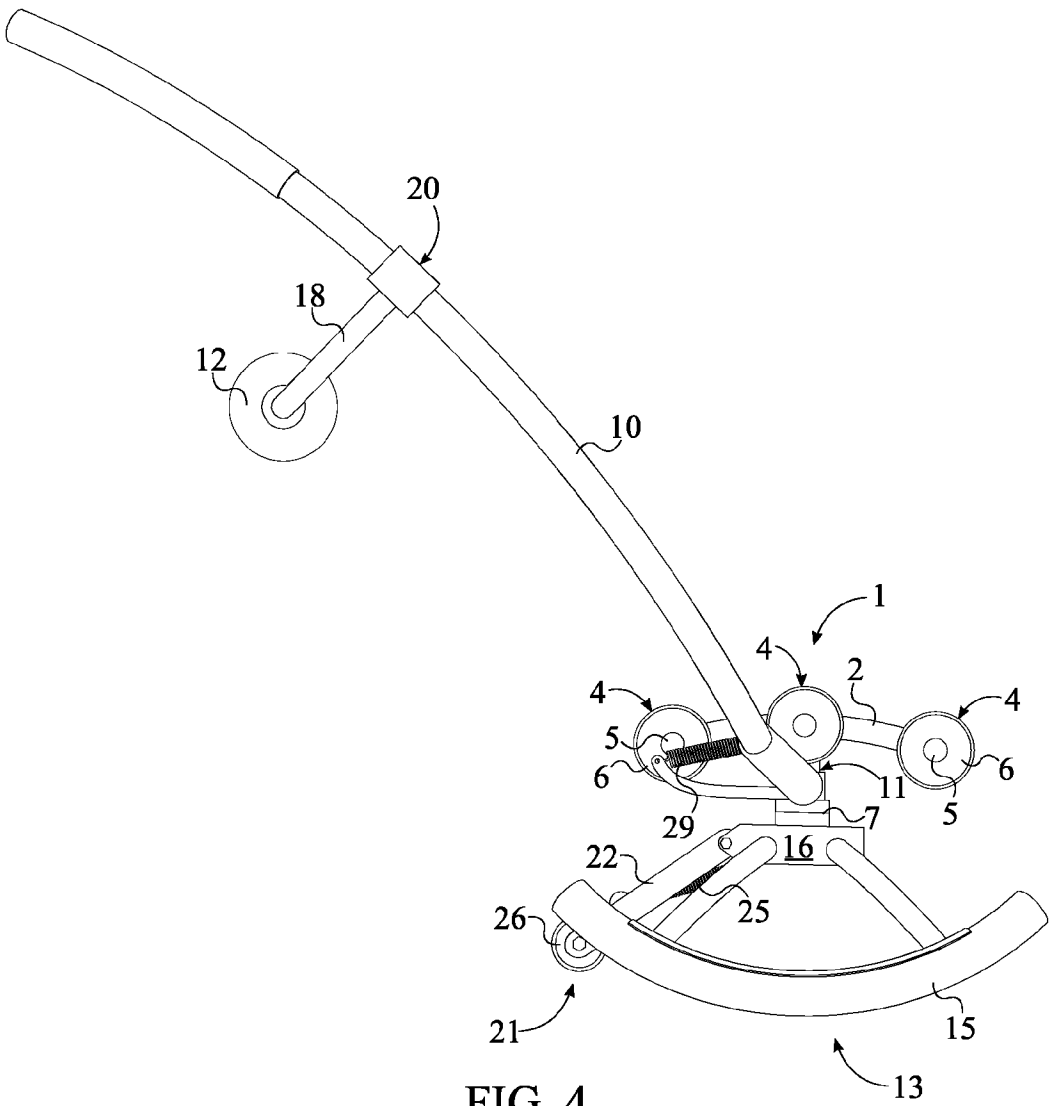
FIG. 4 is a right-side view of the present invention.

Referring to FIG. 1, the present invention comprises the rocking base 13, the backrest 1, a first graspable pole 8, a second graspable pole 10, and a height-adjustable headrest 12. The rocking base 13 elevates and supports the user and comprises a first rocker 14, a second rocker 15, and a bridge 16. The first rocker 14 and the second rocker 15 are each an elongated curved extrusion, similar to the bands of a rocking chair. The preferred first rocker 14 and the second rocker 15 are each composed or covered by a rubber type material to ensure smooth movement on the floor. The bridge 16 is a structural extrusion that connects the first rocker 14 to the second rocker 15 to ensure lateral stability for user while he or she exercises with the present invention. The first rocker 14 is connected to the bridge 16. Similarly, the second bridge 16 is connected to the bridge 16, opposite to the first rocker 14. The first rocker 14 and the second rocker 15 mirror each other across a sagittal plane of the present invention as seen in FIG. 3 and FIG. 4. Resultantly, the rocking base 13 makes contact with the floor at only two points, thus allowing the present invention to rock back and forth in response to a user's weight shift. Because the rocking base 13 is only able to rock in a single direction, the user may more easily control their positioning on the present invention.

The backrest 1 receives and supports weight of the user during exercise. The backrest 1 is a cushioned extrusion that is sized to receive and engage a portion of the user's back. The backrest 1 is adjacently and pivotably mounted to the bridge 16. This allows the backrest 1 to rotate relative to the rocking base 13, thus providing an additional range of motion during the exercise. Additionally, the first rocker 14 and the second rocker 15 are each oriented away from the backrest 1. Resultantly, the user is forced to use stabilizing muscles through the crunch-like exercise, thus stretching and engaging the lateral muscles of the abdominal and core muscles to their full extent.

The first graspable pole 8, the second graspable pole 10, and the height-adjustable headrest 12 provide support for the head and arms of the user while performing exercises on the present invention. The first graspable pole 8 and the second graspable pole 10 act as the gripping elements for the user's hands and are positioned opposite to each other, across the backrest 1. The first graspable pole 8 and the second graspable pole 10 are each preferably an elongated and curved tubular extrusion with padded regions for the user's hands. The preferred curvature for the first graspable pole 8 and the second graspable pole 10 is oriented away from the backrest 1 upwards and outwards in order to provide the use with additional elbow room. A proximal end 9 of the first graspable pole 8 is laterally and rotatably mounted to the backrest 1. Similarly, a proximal end 11 of the second graspable pole 10 is laterally and rotatably mounted to the backrest 1. This allows for relative motion in between the first graspable pole 8, the second graspable pole 10, and the backrest 1. Additionally, this position the first graspable pole 8 and the second graspable pole 10 directly in reaching distance of the user's hands when he or she is leaning on the backrest 1. The height-adjustable headrest 12 provides support for user's head during exercising. The height-adjustable headrest 12 is positioned offset from the backrest 1 and is centrally mounted in between the first graspable pole 8 and the second graspable pole 10. When the user leans on the backrest 1, the height-adjustable headrest 12 is positioned directly under the user's neck and or head region. Traditional crunches, sit ups, and abdominal exercise equipment usually result in the user grabbing the back of his or her head during the exercise in order to compensate and cheat the exercise, thus applying unnecessary pressure onto the neck and upper back region. The height-adjustable headrest 12 prevents unnecessary pressure onto the neck and upper back region and, as a result, the height-adjustable headrest 12 prevents injuries and forces the user to engage the abdominal and core muscles. In the preferred embodiment of the present invention, the height-adjustable headrest 12 also includes a central recessed region which conforms to the contours of the user's body to yield an ergonomic and comfortable fit for the user. In an alternative embodiment of the present invention, the height-adjustable headrest 12 is connected to the backrest 1 instead of the first graspable pole 8 and the second graspable pole 10.

In order to utilize the present invention, the user leans his or her back on the backrest 1 with his or her legs resting in front of the present invention in a bent state. Additionally, the user rests his or head on the height-adjustable headrest 12 while grasping the first graspable pole 8 in one hand and the second graspable pole 10 in the other hand. To perform the crunch-like exercise, the user rocks backwards with the present invention and utilizes his or her core and abdominal muscles to rock forwards and backwards. Additionally, the user may lean to the left or right side of the rocking base 13 in order to rotate the backrest 1 relative to the rocking base 13 throughout the exercise in order to increase the difficulty of the exercise by engaging lateral support muscles.

Figure 5:
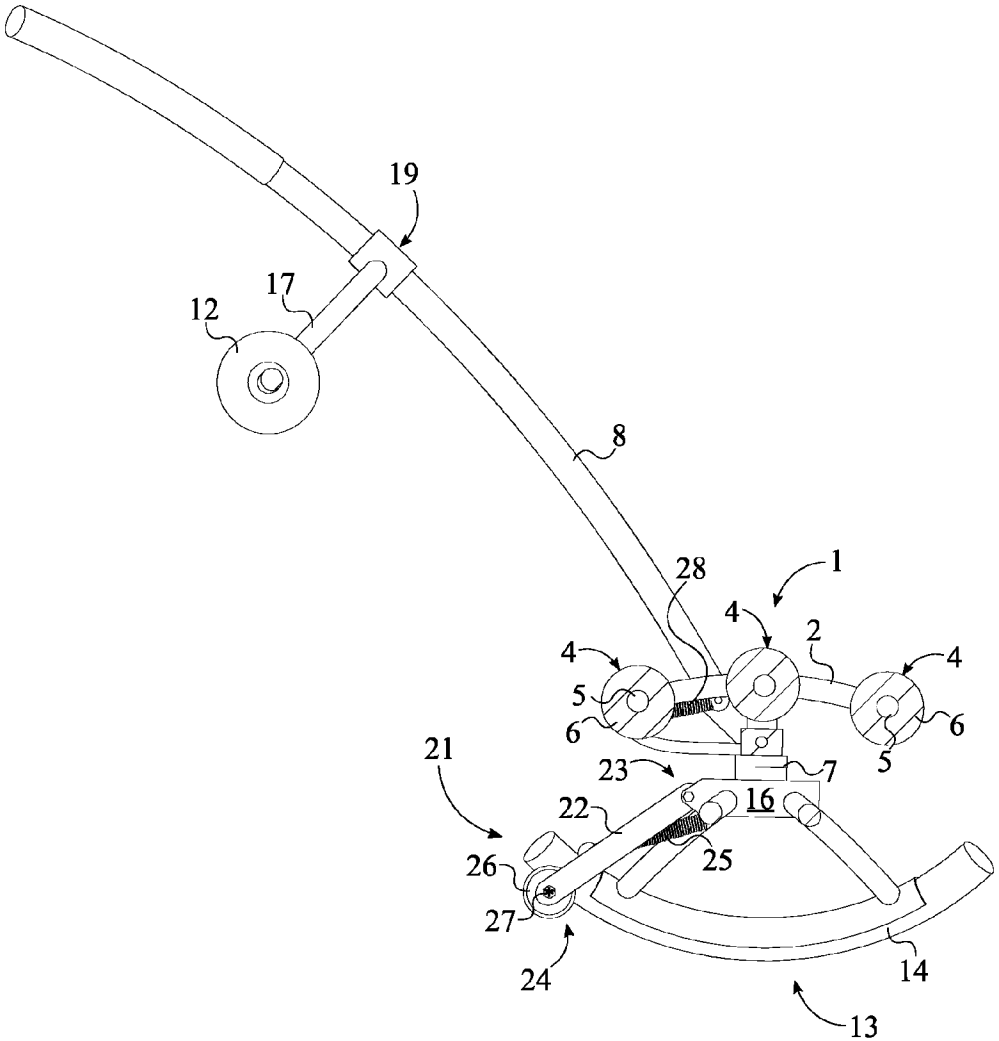
FIG. 5 is a cross-sectional view of the present invention.

Referring to FIG. 1 and FIG. 5, the backrest 1 comprises a curved tubular frame 2, a first plurality of rolling supports 3, a second plurality of rolling supports 4, and a swiveling mechanism 7. The curved tubular frame 2 is a tubular extrusion that is bent to a certain degree in order to conform to the contours of the user's back. The curved tubular frame 2 is the backbone of the backrest 1 and acts as the structural support. The curved tubular frame 2 is rotatable mounted to the bridge 16. The swiveling mechanism 7 is a mechanical swivel which comprises two independent portion that are able to rotate relative to each other. The swiveling mechanism 7 is connected in between the curved tubular frame 2 and the bridge 16. Resultantly, the curved tubular frame 2 is rotatably mounted to the bridge 16 by the swiveling mechanism 7. The first plurality of rolling supports 3 and the second plurality of rolling supports 4 are both used to evenly distribute the weight of the user along the curved tubular frame 2. The first plurality of rolling supports 3 and the second plurality of rolling supports 4 are evenly distributed along the curved tubular frame 2 in order to maximize comfort and support. The first plurality of rolling supports 3 is laterally mounted to the curved tubular frame 2. The second plurality of rolling supports 4 is also laterally mounted to the curved tubular frame 2, but is positioned opposite the first plurality of rolling supports 3. For symmetric support, each of the first plurality of rolling supports 3 is positioned adjacent to a corresponding roller from the second plurality of rolling supports 4 as seen in FIG. 1. As the user exercise with the present invention, each of the supports from the first plurality of rolling supports 3 and the second plurality of rolling supports 4 is able to rotate individually, allowing the user to move unimpeded.

Referring to FIG. 1, each rolling support from the first plurality of rolling supports 3 and from the second plurality of rolling supports 4 comprises an arm 5 and a cushioned roller 6. The arm 5 acts as the structural element and is laterally connected to the curved tubular frame 2. The cushioned roller 6 is rotatably mounted about the arm 5 and is used to distribute weight evenly onto the arm 5. The cushioned roller 6 has a greater surface area than the arm 5 so that the user does not experience pressure at any point on their back.

Figure 2:
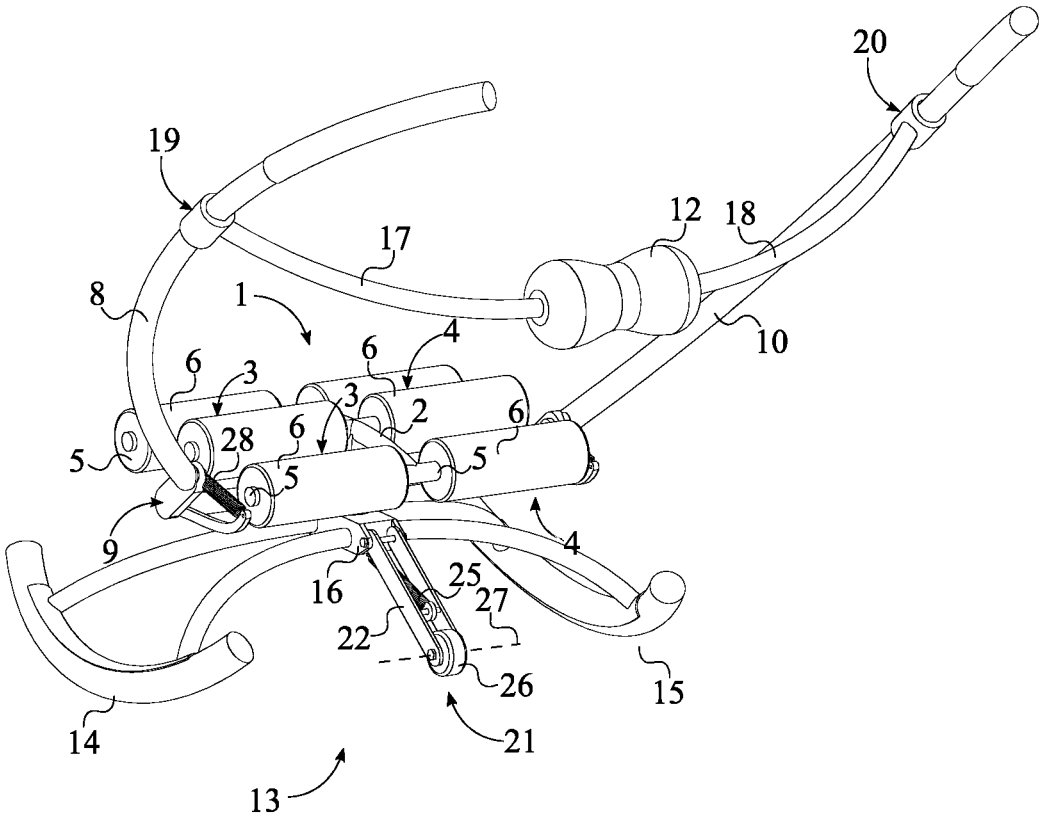
FIG. 2 is an alternative view of the present invention.

Referring to FIG. 2, the height-adjustable headrest 12 is mounted to the first graspable pole 8 and the second graspable pole 10 by a first headrest bar 17, a second headrest bar 18, a first locking mechanism 19, and a second locking mechanism 20. The first headrest bar 17 and the second headrest bar 18 are each an elongated tubular structure that are positioned opposite of each other across the height-adjustable headrest 12. The first headrest bar 17 is positioned in between the height-adjustable headrest 12 and the first graspable pole 8. In particular, the first headrest bar 17 is terminally connected to the height-adjustable headrest 12. Opposite of the height-adjustable headrest 12, the first headrest bar 17 is terminally and slidably attached to the first graspable pole 8. The first headrest bar 17 is secured to the first graspable pole 8 by the first locking mechanism 19. The first locking mechanism 19 is mechanically integrated in between the first graspable pole 8 and the first headrest bar 17. In a similar fashion, the second headrest bar 18 is positioned in between the height-adjustable headrest 12 and the second graspable pole 10. In particular, the second headrest bar 18 is terminally connected to the height-adjustable headrest 12. Opposite of the height-adjustable headrest 12, the second headrest bar 18 is terminally and slidably attached to the second graspable pole 10. The second headrest bar 18 is secured to the second graspable pole 10 by the second locking mechanism 20. The second locking mechanism 20 is mechanically integrated in between the second graspable pole 10 and the second headrest bar 18. The user may unlock the first locking mechanism 19 and the second locking mechanism 20 in order to raise or lower the height-adjustable headrest 12 to his or her personal preference. This configuration ensures that the present invention is compatible with a variety of body types. In one embodiment of the present invention, the first locking mechanism 19 and the second locking mechanism 20 are each a screw clamp. Although, a variety of alternative mechanisms may be used instead.

The present invention also utilizes a couple of mechanisms in order to return the present invention into the original orientation and aid the user throughout the movement of the exercise. One of these mechanisms is a retracting mechanism 21. The retracting mechanism 21 comprises an elongated arm 22, a spring 25, and a wheel 26. The elongated arm 22 is an elongated support structure which acts as a mobile third leg for the present invention. The elongated arm 22 is positioned parallel to and in between the first rocker 14 and the second rocker 15. A first end 23 of the elongated arm 22 is pivotably connected to the bridge 16, opposite the backrest 1. A second end 24 of the elongated arm 22 is pressed against the floor and is able to transition about the floor through the wheel 26. The wheel 26 is rotatably connected to the second end 24 of the elongated arm 22 with a rotation axis 27 of the wheel 26 being oriented perpendicular to the bridge 16. This ensures that the wheel 26 travels in a linear path that is parallel to the first rocker 14 and the second rocker 15. The spring 25 is tensionably connected in between the bridge 16 and the second end 24 of the elongated arm 22 in order to apply a return force on the elongated arm 22. When the present invention is leaned backwards, the return force pulls the elongated arm 22 towards the bridge 16, which in turn pushes the backrest 1 to the original vertical orientation.

The present invention also comprises a first elastic resistor 28 and a second elastic resistor 29 which ensure that the first graspable pole 8, the second graspable pole 10, and the height-adjustable headrest 12 return to a semi-upright orientation. The first elastic resistor 28 is tensionably connected in between the first graspable pole 8 and the backrest 1. Similarly, the second elastic resistor 29 is tensionably connected in between the second graspable pole 10 and the backrest 1. It is preferred that the first elastic resistor 28 and the second elastic resistor 29 are each a tension spring 25. At the apex of the exercise motion, the first elastic resistor 28 and the second elastic resistor 29 are expanded and thus apply a force which pulls the first graspable pole 8, the second graspable pole 10, and therefore the height-adjustable headrest 12 towards the backrest 1 and into a semi-upright orientation.

In an alternative embodiment of the present invention, the first rocker 14 and the second rocker 15 are replaced with four fixed legs. The fixed legs act as stationary support structures for the present invention, similar to the legs of a table. Each of the fixed legs is laterally connected to the bridge 16. In this embodiment, the backrest 1 is pivotably connected to the bridge 16 through a pivot joint. The pivot joint allows the backrest 1 to rotate relative to the bridge 16 and to tilt forwards and backwards relative to the bridge 16, thus achieving the rocking motion provided by the first rocker 14 and the second rocker 15 in the preferred embodiment.

Although the invention has been explained in relation to its preferred embodiment, it is to be understood that many other possible modifications and variations can be made without departing from the spirit and scope of the invention as hereinafter claimed.

What is claimed is:

1. A core roller twist exercise machine comprises:
- a backrest;
- a first graspable pole;
- a second graspable pole;
- a height-adjustable headrest;
- a rocking base;
- the rocking base comprises a first rocker, a second rocker, and a bridge;
- the first rocker being connected to the bridge;
- the second rocker being connected to the bridge, opposite to the first rocker;
- the backrest being adjacently and pivotably mounted to the bridge;
- the first rocker and the second rocker being oriented away from the backrest;
- the first graspable pole and the second graspable pole being positioned opposite to each other, across the backrest;
- a proximal end of the first graspable pole being laterally and rotatably mounted to the backrest;
- a proximal end of the second graspable pole being laterally and rotatably mounted to the backrest; and
- the height-adjustable headrest being centrally mounted in between the first graspable pole and the second graspable pole.

2. The core roller twist exercise machine as claimed in claim 1 comprises:
- the backrest comprises a curved tubular frame, a first plurality of rolling supports, and a second plurality of rolling supports;
- the first plurality of rolling supports being laterally mounted to the curved tubular frame;
- the second plurality of rolling supports being laterally mounted to the curved tubular frame, opposite to the first plurality of rolling supports;
- the first plurality of rolling supports and the second plurality of rolling supports being distributed along the curved tubular frame;
- each of the first plurality of rolling supports being positioned adjacent to a corresponding roller from the second plurality of rolling supports; and
- the curved tubular frame being rotatably mounted to the bridge.

3. The core roller twist exercise machine as claimed in claim 2 comprises:
- each rolling support from the first plurality of rolling supports and from the second plurality of rolling supports comprises an arm and a cushioned roller;
- the arm being laterally connected to the curved tubular frame;
- the cushioned roller being rotatably mounted about the arm.

4. The core roller twist exercise machine as claimed in claim 2 comprises:
- the backrest further comprises a swiveling mechanism;
- the swiveling mechanism being connected in between the curved tubular frame and the bridge; and
- the curved tubular frame being rotatably mounted to the bridge by the swiveling mechanism.

5. The core roller twist exercise machine as claimed in claim 1 comprises:
- a first headrest bar;
- a second headrest bar;
- a first locking mechanism;
- a second locking mechanism;
- the first headrest bar being positioned in between the height-adjustable headrest and the first graspable pole;
- the first headrest bar being terminally connected to the height-adjustable headrest;
- the first headrest bar being terminally and slidably attached to the first graspable pole;
- the first locking mechanism being mechanically integrated in between the first graspable pole and the first headrest bar;
- the second headrest bar being positioned in between the height-adjustable headrest and the second graspable pole;
- the second headrest bar being terminally connected to the height-adjustable headrest;
- the second headrest bar being terminally and slidably attached to the second graspable pole; and
- the second locking mechanism being mechanically integrated in between the second graspable pole and the second headrest bar.

6. The core roller twist exercise machine as claimed in claim 1 comprises:
- a retracting mechanism;
- the retracting mechanism comprises an elongated arm, a spring, and a wheel;
- the elongated arm being positioned parallel to and in between the first rocker and the second rocker;
- a first end of the elongated arm being pivotably connected to the bridge, opposite the backrest;
- the wheel being rotatably connected to a second end of the elongated arm;
- the spring being tensionably connected in between the bridge and the second end of the elongated arm; and
- a rotation axis of the wheel being oriented perpendicular to the bridge.

7. The core roller twist exercise machine as claimed in claim 1 comprises:
- a first elastic resistor;

a second elastic resistor;

the first elastic resistor being tensionably connected in between the first graspable pole and the backrest; and the second elastic resistor being tensionably connected in between the first graspable pole and the backrest.

8. The core roller twist exercise machine as claimed in claim 7 comprises, wherein the first elastic resistor and the second elastic resistor are each a tension spring.

9. A core roller twist exercise machine comprises:

a backrest;

a first graspable pole;

a second graspable pole;

a height-adjustable headrest;

a rocking base;

the rocking base comprises a first rocker, a second rocker, and a bridge;

the first rocker being connected to the bridge;

the second rocker being connected to the bridge, opposite to the first rocker;

the backrest being adjacently and pivotably mounted to the bridge;

the first rocker and the second rocker being oriented away from the backrest;

the first graspable pole and the second graspable pole being positioned opposite to each other, across the backrest;

a proximal end of the first graspable pole being laterally and rotatably mounted to the backrest;

a proximal end of the second graspable pole being laterally and rotatably mounted to the backrest;

the height-adjustable headrest being centrally mounted in between the first graspable pole and the second graspable pole;

the backrest comprises a curved tubular frame, a first plurality of rolling supports, and a second plurality of rolling supports;

the first plurality of rolling supports being laterally mounted to the curved tubular frame;

the second plurality of rolling supports being laterally mounted to the curved tubular frame, opposite to the first plurality of rolling supports;

the first plurality of rolling supports and the second plurality of rolling supports being distributed along the curved tubular frame;

each of the first plurality of rolling supports being positioned adjacent to a corresponding roller from the second plurality of rolling supports; and the curved tubular frame being rotatably mounted to the bridge.

10. The core roller twist exercise machine as claimed in claim 9 comprises:

each rolling support from the first plurality of rolling supports and from the second plurality of rolling supports comprises an arm and a cushioned roller;

the arm being laterally connected to the curved tubular frame; and the cushioned roller being rotatably mounted about the arm.

11. The core roller twist exercise machine as claimed in claim 9 comprises:

the backrest further comprises a swiveling mechanism;

the swiveling mechanism being connected in between the curved tubular frame and the bridge; and the curved tubular frame being rotatably mounted to the bridge by the swiveling mechanism.

12. The core roller twist exercise machine as claimed in claim 9 comprises:

a first headrest bar;

a second headrest bar;

a first locking mechanism;

a second locking mechanism;

the first headrest bar being positioned in between the height-adjustable headrest and the first graspable pole;

the first headrest bar being terminally connected to the height-adjustable headrest;

the first headrest bar being terminally and slidably attached to the first graspable pole;

the first locking mechanism being mechanically integrated in between the first graspable pole and the first headrest bar;

the second headrest bar being positioned in between the height-adjustable headrest and the second graspable pole;

the second headrest bar being terminally connected to the height-adjustable headrest;

the second headrest bar being terminally and slidably attached to the second graspable pole; and the second locking mechanism being mechanically integrated in between the second graspable pole and the second headrest bar.

13. The core roller twist exercise machine as claimed in claim 9 comprises:

a retracting mechanism;

the retracting mechanism comprises an elongated arm, a spring, and a wheel;

the elongated arm being positioned parallel to and in between the first rocker and the second rocker;

a first end of the elongated arm being pivotably connected to the bridge, opposite the backrest;

the wheel being rotatably connected to a second end of the elongated arm;

the spring being tensionably connected in between the bridge and the second end of the elongated arm; and a rotation axis of the wheel being oriented perpendicular to the bridge.

14. The core roller twist exercise machine as claimed in claim 9 comprises:

a first elastic resistor;

a second elastic resistor;

the first elastic resistor being tensionably connected in between the first graspable pole and the backrest; and the second elastic resistor being tensionably connected in between the first graspable pole and the backrest.

15. The core roller twist exercise machine as claimed in claim 14 comprises, wherein the first elastic resistor and the second elastic resistor are each a tension spring.

* * * * *